US005199916A

United States Patent [19]

Prickett

[11] Patent Number: 5,199,916

[45] Date of Patent: Apr. 6, 1993

[54] RELEASABLE ANCHOR PLUG

[76] Inventor: Timothy B. Prickett, 95-2051 Waikalani Pl., #604-E, Mililani, Hi. 96789

[21] Appl. No.: 779,064

[22] Filed: Oct. 17, 1991

[51] Int. Cl.[5] ..... B63B 35/79; B63B 1/00; B63B 35/00

[52] U.S. Cl. ..... 441/75; 441/74; 441/65

[58] Field of Search ..... 441/74, 75, 60, 65, 441/68; 114/39.2

[56] References Cited

U.S. PATENT DOCUMENTS

| | | | |
|---|---|---|---|
| 2,567,069 | 9/1951 | Harley | 24/221 |
| 2,946,305 | 7/1960 | Hill | 114/35 |
| 3,181,861 | 5/1962 | Wilkinson | 441/74 |
| 3,380,425 | 4/1968 | Wilson | 114/235 |
| 3,802,374 | 4/1974 | Brown | 441/74 |
| 3,860,209 | 1/1975 | Strecker | 248/119 R |
| 4,216,567 | 8/1980 | Heinz | 24/81 J |
| 4,400,856 | 8/1983 | Tseng | 24/221 R |
| 4,457,650 | 7/1984 | Tseng | 410/111 |
| 4,622,726 | 11/1986 | Nakamura | 24/590 |
| 4,645,392 | 2/1987 | Takaguchi | 410/80 |
| 4,685,237 | 8/1987 | Hugg | 42/85 |
| 4,712,394 | 12/1987 | Bull | 441/74 |
| 4,820,220 | 4/1989 | Fruzzetti | 441/74 |
| 4,938,725 | 7/1990 | Beck | 441/74 |

*Primary Examiner*—Joseph F. Peters, Jr.
*Assistant Examiner*—Kenneth Lee
*Attorney, Agent, or Firm*—Martin E. Hsia

[57] ABSTRACT

An improved anchor plug allowing quick release of a leash. The anchor plug is preferably made of plastic and may be mounted on a surfboard, or any other object flush to the top surface of the surfboard. The anchor plug has a leash cavity and a retractable leash pin spanning the leash cavity. Preferably, the leash pin extends into a locking hole when it is in the extended position. A loop can be formed in a leash, the leash pin can be retracted to allow the loop to be inserted in the leash cavity, and the pin can be extended to retain the loop in the leash cavity. Preferably, the leash pin is made of stainless steel and can be locked in the extended position.

19 Claims, 1 Drawing Sheet

RELEASABLE ANCHOR PLUG

DESCRIPTION

1. Technical Field

This invention relates to a releasable anchor plug for easily detaching and attaching a leash to an object such as a surfboard or a boat.

Surfers usually tie their surfboards to their ankles by a leash that is detachably fastened to the surfboard. It would be dangerous to provide any type of fastening device to the surfboard end of the leash because the surfer could be injured if the fastening device became detached during use. Thus, any device for detachably fastening a leash to a surfboard must not require attaching anything to the end of the leash.

It would be preferable for any type of fastening device to be flush with the surface of the surfboard so that the surfer will not be injured by any projections upon impact with the surfboard and to avoid altering the hydrodynamic characteristics of the surfboard.

Surfboards now are usually provided with an anchor plug having a cavity and a fixed leash pin spanning the cavity. The anchor plug is usually recessed into the surfboard, flush with the top surface. The surfer's leash is usually tied around the fixed leash pin. This construction provides assurance that the leash will not become detached regardless of the direction in which it is pulled during surfing, unless the leash becomes untied. If the leash becomes untied, the surfer would only be hit by the leash. However, this construction is inconvenient because the leash must be tied and untied in order to attach and detach it to the surfboard's anchor plug.

2. Background Art

U.S. Pat. No. 4,712,394 to Bull discloses an arrangement for providing a secure tie point using a lock to protect a surfboard from being stolen, by threading a cable or chain through the surfboard, attaching it around a solid object and locking it, similar to locking a bicycle.

U.S. Pat. No. 3,802,374 to Brown discloses a cylindrical body attached to a surfboard with a frictionally engageable shaft having an eyelet for towing the surfboard behind a boat.

U.S. Pat. No. 3,380,425 to Wilson discloses various arrangements for attaching a towing line to a surfboard, including a cam chock in FIG. 6 and a capstan and loop connection in FIG. 8. However, these types of connections might become detached if the towing line is pulled in certain directions.

None of these references provides a detachable fastening means that does not require attaching a device to the end of the leash, that would not become detached regardless of the direction in which the leash is pulled, and that can be mounted flush with the surface of a surfboard. Thus, there has long been a need for an anchor plug on a surfboard that allows easy attachment and detachment of a leash, without requiring tying or untying the leash to the surfboard, and yet retains the advantages of the anchor plugs currently being used.

It is therefore an object of this invention to provide a means for quickly and easily attaching and detaching a leash to a surfboard, rather than tying or untying the leash from an anchor plug with a stationary pin.

It is a still further object of this invention to provide such a means that is comparable in strength and reliability to an anchor plug using a stationary pin.

It is a still further object of this invention to provide such a means that can be retrofitted to replace existing anchors.

It is a still further object to provide such a means that can be mounted flush with a surface.

DISCLOSURE OF INVENTION

These and other objects are achieved by a releasable anchor plug, comprising a housing having a leash cavity with a retractable leash pin spanning the leash cavity when the pin is in its extended position. Preferably, a locking means (such as a sliding snap with a lip that engages in a groove) for locking the leash pin in the extended position is provided. Preferably also, a locking hole for receiving the end of the leash pin is provided in the housing so that the leash pin extends into the locking hole when it is in the extended position, thereby supporting the leash pin on both sides of the leash cavity when it is in the extended position. A cover plate having spring fingers is preferably inserted into the cavity for the snap, with the cover plate covering the cavity and the spring fingers supporting the snap to retain the lip of the snap in the groove when locked. Preferably also, the housing has the same configuration as anchor plugs currently being used so that it can be retrofitted to existing surfboards.

To use the invention, a loop is formed in the leash and the leash is fastened simply by retracting the pin, passing the loop over the end of the retracted pin and into the leash cavity, and then extending the pin until it is received in the locking hole, thereby spanning the leash cavity and retaining the loop, thus ensuring positive and reliable attachment of the leash to the surfboard. To detach the leash, the leash pin is retracted to prevent the leash pin from spanning the leash cavity, thereby creating a space between the end of the leash pin and the housing; the loop is passed through this space.

The top of the leash anchor plug is preferably mounted flush to the deck of the surfboard, by drilling a hole slightly larger in diameter than the leash anchor plug itself and deep enough to accept the leash plug, then cementing the plug to the surfboard with polyester resin.

The retractable leash pin preferably comprises stainless steel and is preferably attached to a snap that is mounted to slide between open and closed positions. Preferably also, locking means is provided to lock the snap (and therefore the leash pin) in the extended position to span the leash cavity. The relatively open design of the invention also allows easy cleaning by flushing with water.

BEST MODE FOR CARRYING OUT INVENTION

Figure 1:
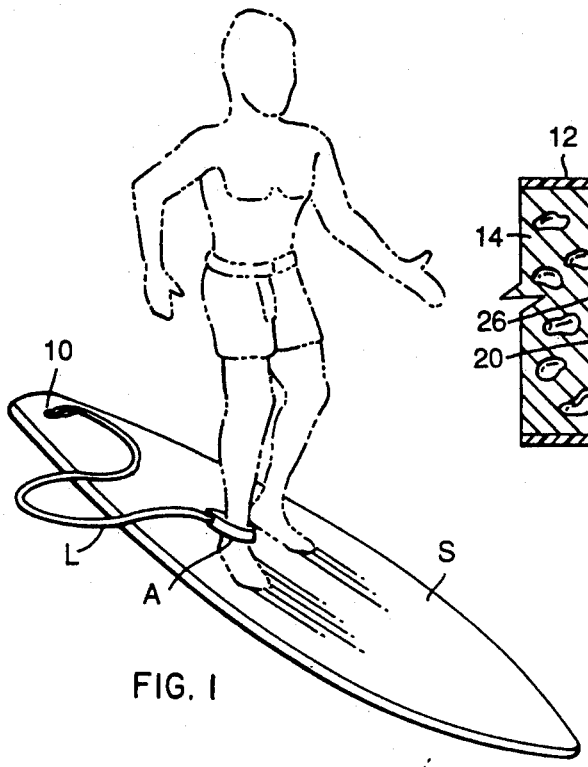
FIG. 1 is a perspective view generally showing a preferred embodiment of the invention when installed and used on a surfboard.

Referring to FIG. 1, generally shown is installation of the anchor plug 10 on a surfboard S. The surfer's leash L connects the anchor plug 10 to the surfer's ankle A.

Figure 2:
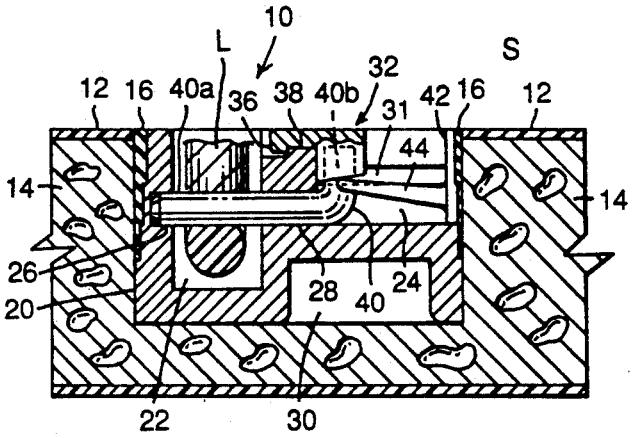
FIG. 2 is a sectional view of the embodiment of FIG. 1 as installed in a surfboard showing the surrounding environment.
Figure 3:
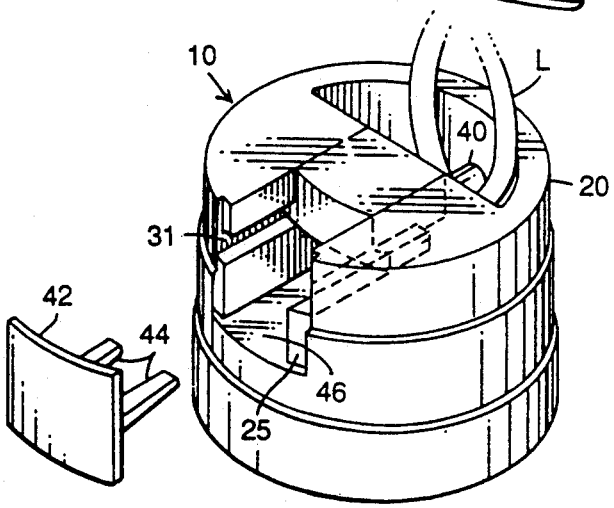
FIG. 3 is a perspective exploded view of the embodiment of FIG. 2.
Figure 4:
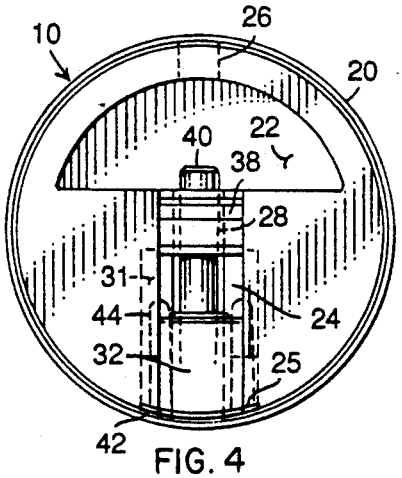
FIG. 4 is a top plan view of the embodiment of FIG. 2 showing the leash pin in the retracted position.
Figure 5:
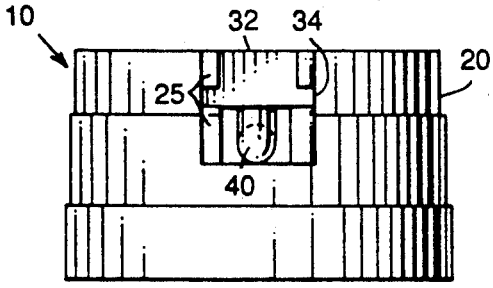
FIG. 5 is a front elevational view of the embodiment of FIG. 2 with the cover plate removed.
Figure 6:
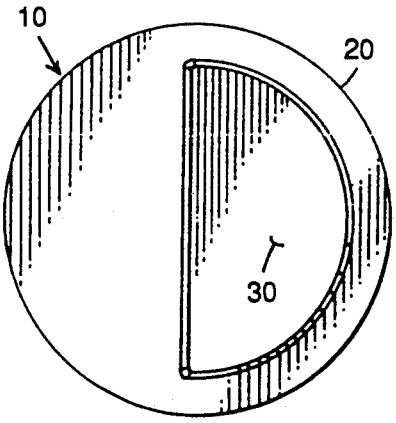
FIG. 6 is a bottom plan view of the embodiment of FIG. 2 showing the leash cavity.

Referring to FIG. 2, shown is a cross section of the anchor plug 10 installed in the surfboard S. The anchor plug 10 is preferably installed by drilling a hole slightly larger than the anchor plug 10 into the top surface of the surfboard S, through the top layer of fiberglass 12 and into the foam 14 in the inner core of the surfboard. The anchor plug 10 would preferably be inserted in the hole and cemented permanently in place by pouring polyester resin 16 between the anchor plug 10 and the foam 14. The top surface of the anchor plug 10 preferably would be sanded flush to the top surface of the surfboard S.

Referring to FIGS. 2 to 6, the anchor plug 10 preferably comprises a plastic housing 20 having an outer cylindrical configuration comprising a plurality (preferably three) of cylinders of graduated diameters, creating a ridged shape for better retention by the polyester resin 16. The housing 20 preferably is provided with a leash cavity 22, a snap cavity 24, and a cover plate recess 25, as well as a locking hole 26, a center hole 28 and a bottom core cavity 30. Two snap channels 31 are preferably formed in the sides of the snap cavity 24. The leash cavity 22 provides a space to accept the leash L for attachment. The snap cavity 24 provides a space for a snap 32 to slide between the extended and retracted positions when extending and retracting a leash pin 40. The locking hole 26 accepts the end of the leash pin 40 when it is extended so that the leash pin 40 is supported on both sides of the leash cavity 22 when it is extended. The center hole 28 allows the leash pin 40 to pass into the leash cavity 22, provides support for the leash pin 22 on one side of the leash cavity 22 and guides the leash pin 40 to be received in the locking hole 26 when the leash pin 40 is extended. The bottom core cavity 30 has no functional purpose except to reduce the amount of material necessary to make the housing. The snap channels 31 guide the snap 32 between the extended and retracted positions.

The snap 32 preferably has two flanges 34 conforming to the snap channels 31 on the sides and is preferably slidably mounted by inserting the flanges 34 into the snap channels 31. The snap 32 is preferably provided with a lip 36 that locks into a groove 38 in the housing 20 when the snap 32 is slid towards the leash cavity 22.

An L shaped leash pin 40 is inserted through the center hole 28 so the long portion 40*a* can slide across the leash cavity 22 and into the locking hole 26, thus spanning the leash cavity 22. The short portion 40*b* is preferably mounted in the snap 32. The leash pin 40 is preferably made of stainless steel.

Preferably a plastic cover plate 42 configured to fit into the cover plate recess 25 and having inwardly projecting cantilevered spring fingers 44 (preferably integrally formed with the cover plate 42) is provided to close off the snap cavity 24 along the circumference of the housing 20. This helps prevent leakage of the resin 16 into the housing 20. The spring fingers 44 preferably project into finger channel 46 and retain the snap 32 in position so that the lip 36 remains locked into the groove 38 when the snap is in the engaged position. This helps to prevent accidental disengagement of the lip 36 from the groove 38 by rocking of the snap 32.

In use, the long portion 40*a* of the leash pin 40 slides between extended and retracted positions by sliding the snap 32 towards and away from the leash cavity 22. The long portion 40*a* can be locked in the extended position by sliding the lip 36 of the snap 32 until it locks into the groove 38. When locked into the extended position, the long portion of the leash pin 40*a* spans the leash cavity 22 and secures the leash L as securely as if the leash pin were stationery. Yet, the long portion of the leash pin 40*a* also can be retracted easily by disengaging the lip 36 of the snap 32 from the groove 38 and sliding the snap 32 away from the leash cavity 22, so that the leash L can be easily detached merely by passing the loop in the leash L between the housing 20 and the end of the long portion 40*a* of the leash pin 40.

The invention has been described with respect to a particular preferred embodiment. It will be obvious to those skilled in the art that changes and modifications can be made to the embodiment described above without departing from the spirit and scope of the invention. For example, the leash pin can be biased in the engaged position by a spring or other equivalent means, or can be locked into the extended position with some other type of lock. For a further example, the snap can be slidably mounted using some means other than flanges projecting into channels in the housing. Of course, the housing, leash pin and snap can be made of other materials and, although not preferred, a separate snap can be eliminated by providing a separate locking aperture in the housing adapted to receive and lock the short portion of the leash pin. Accordingly, no limitations are to be implied or inferred in the scope of the invention except as specifically and explicitly set forth in the attached claims.

INDUSTRIAL APPLICABILITY

This invention can be used wherever an object needs to be detachably attached to a leash or other cord-like material regardless of the direction in which the leash might be pulled, and where the anchor must remain flush with a surface of the object. Thus, it can be used in various marine applications, such as in securing water boards and boats, but can also be used in non-marine applications.

What is claimed is:

1. A releasable anchor plug, comprising:
a housing having a leash cavity; and
a leash pin slidably mounted in said housing and spanning said leash cavity, whereby retracting said leash pin prevents said leash pin from spanning said leash cavity.

2. A releasable anchor plug, comprising:
a housing having a leash cavity and a locking hole in said leash cavity; and
a leash pin slidably mounted in said housing and spanning said leash cavity and extending into said locking hole, whereby retracting said leash pin prevents said pin from spanning said leash cavity.

3. An improved waterboard, comprising:
a board having an anchor aperture;
a housing having a leash cavity and a locking hole in said leash cavity mounted in said anchor aperture; and
a leash pin slidably mounted in said housing and spanning said leash cavity and extending into said locking hole, whereby retracting said leash pin prevents said pin from spanning said leash cavity.

4. A releasable anchor plug, according to claim 1 or 2, further comprising:

locking means for locking said leash pin in position when said leash pin spans said leash cavity.

5. A releasable anchor plug, comprising:

a housing having a leash cavity;

a leash pin retractably mounted in said housing and spanning said leash cavity, whereby retracting said leash pin prevents said leash pin from spanning said leash cavity; and locking means for locking said leash pin in position when said leash pin spans said leash cavity;

wherein said locking means comprises a snap slidably mounted on said housing.

6. A releasable anchor plug, according to claim 5, wherein:

said housing is approximately cylindrical in exterior shape.

7. A releasable anchor plug, according to claim 6, wherein said housing comprises a plurality of cylinders of graduated diameters.

8. A releasable anchor plug, comprising:

a housing having a leash cavity; and a leash pin retractably mounted in said housing and spanning said leash cavity, whereby retracting said leash pin prevents said leash pin from spanning said leash cavity;

wherein said leash pin comprises an approximately L shaped member.

9. A releasable anchor plug, according to claim 1 or 2, wherein said leash pin comprises stainless steel.

10. A releasable anchor plug, comprising:

a housing having a leash cavity and a locking hole in said leash cavity;

a leash pin retractably mounted in said housing and spanning said leash cavity and extending into said locking hole, whereby retracting said leash pin prevents said pin from spanning said leash cavity; and locking means for locking said leash pin in position when said leash pin spans said leash cavity;

wherein said locking means comprises a snap slidably mounted on said housing.

11. A releasable anchor plug, according to claim 10, wherein:

said housing is approximately cylindrical in exterior shape.

12. A releasable anchor plug, according to claim 11, wherein said housing comprises a plurality of cylinders of graduated diameters.

13. A releasable anchor plug, comprising:

a housing having a leash cavity and a locking hole in said leash cavity; and a leash pin retractably mounted in said housing and spanning said leash cavity and extending into said locking hole, whereby retracting said leash pin prevents said pin from spanning said leash cavity;

wherein said leash pin comprises an approximately L shaped member.

14. An improved waterboard, according to claim 3, further comprising:

locking means for locking said leash pin in position when said leash pin spans said leash cavity.

15. An improved waterboard, comprising:

a board having an anchor aperture;

a housing having a leash cavity and a locking hole in said leash cavity mounted in said anchor aperture;

a leash pin retractably mounted in said housing and spanning said leash cavity and extending into said locking hole, whereby retracting said leash pin prevents said pin from spanning said leash cavity; and locking means for locking said leash pin in position when said leash pin spans said leash cavity;

wherein said locking means comprises a snap slidably mounted on said housing.

16. An improved waterboard, according to claim 15, wherein:

said housing is approximately cylindrical in exterior shape.

17. An improved waterboard, according to claim 16, wherein said housing comprises a plurality of cylinders of graduated diameters.

18. An improved waterboard, comprising:

a board having an anchor aperture;

a housing having a leash cavity and a locking hole in said leash cavity mounted in said anchor aperture;

a leash pin retractably mounted in said housing and spanning said leash cavity and extending into said locking hole, whereby retracting said leash pin prevents said pin from spanning said leash cavity;

wherein said leash pin comprises an approximately L shaped member.

19. An improved waterboard, according to claim 3, wherein said leash pin comprises stainless steel.

* * * * *